United States Patent [19]

Street

[11] 4,333,795

[45] Jun. 8, 1982

[54] CHEMICAL COMPOSITIONS USEFUL AS PAPER SIZING AGENTS AND METHOD OF MAKING SAME

[75] Inventor: Peter C. Street, Langho, England

[73] Assignee: Tenneco Chemicals, Inc., Piscataway, N.J.

[21] Appl. No.: 137,677

[22] Filed: Apr. 7, 1980

[30] Foreign Application Priority Data

May 23, 1979 [GB] United Kingdom ..... 7918031

[51] Int. Cl.[3] ..... D21D 3/00; D21H 3/28; D21H 3/34; C09D 3/40

[52] U.S. Cl. ..... 162/168 N; 162/175; 162/177; 162/180; 106/200; 106/212; 106/218; 427/391; 427/395; 524/272; 524/548

[58] Field of Search ..... 106/173 RQ, 212, 213, 106/218, 238, 200; 162/158, 168 R, 168 N, 169, 175, 177, 135, 164 R, 180; 260/17.45 T, 29.6 R, 17 R; 427/391, 395

[56] References Cited

U.S. PATENT DOCUMENTS

| | | | |
|---|---|---|---|
| 3,419,465 | 12/1968 | Maruta | 106/238 X |
| 3,421,976 | 1/1969 | Jones | 162/180 |
| 3,565,755 | 2/1971 | Davison | 162/180 X |
| 4,029,885 | 6/1977 | Buikema | 536/50 |
| 4,207,223 | 6/1980 | Schülde et al. | 260/29.6 WB |

*Primary Examiner*—Michael R. Lusignan

[57] ABSTRACT

Stable aqueous dispersions which are useful as one-shot sizing agents for paper, i.e. which do not require the separate addition of a flocculating agent, are prepared by combining a rosin dispersion, aluminum sulfate, and an alkali in a prescribed manner. The dispersions may also contain an added stabilizer such as a starch derivative, hydroxyethyl cellulose, or polyvinyl pyrrolidone if desired. These compositions can be used for either internal or external sizing.

23 Claims, No Drawings

CHEMICAL COMPOSITIONS USEFUL AS PAPER SIZING AGENTS AND METHOD OF MAKING SAME

BACKGROUND OF THE INVENTION

1. Field of the Invention

This invention relates to chemical compositions based upon rosin and reaction products of rosin with other substances and is concerned, in particular, with chemical compositions which are made from stable dispersions of rosin or rosin-based products and which are themselves in the form of stable dispersions. The invention also relates to processes of manufacture of the chemical compositions of the invention and to processes employing these chemical compositions, such as the sizing of paper.

2. Description of the Prior Art

Stable dispersions of rosin or rosin-based products are well-known and have long been used, especially as sizing agents in the manufacture of paper. In this specification, the term "paper" is used, for convenience, to mean all forms of paper, paperboard and related products whose manufacture involves the employment of a sizing agent upon cellulosic or other fibres. Paper sizing agents are usually employed either by being added to the cellulosic or other fibre stock from which a web is later made or by being applied to the surface after the web has been formed. Rosin-based sizing agents depend for their sizing upon the formation of electrostatic bonds between the sizing agent and the cellulosic or other fibres of the paper stock or web. Highly efficient sizing agents developed more recently include many kinds which, in use, form chemical bonds and thus are known as "reactive" sizing agents. A major development in the paper sizing art was the discovery that reaction products formed by rosin or unsaturated compounds present in rosin, on the one hand, and unsaturated carboxylic acids or their anhydrides on the other hand, especially maleic or furmaric acid or maleic anhydride, have greatly enhanced sizing efficiency, as compared with sizing agents which are essentially dispersions of rosin itself. These so-called "maleated" rosin reaction products and other related sizing agents are rather expensive to make and so they were often used to fortify conventional rosin dispersions, rather than to replace them, and the resultant compositions are commonly known as "fortified sizing agents".

In practice, all types of paper sizing agents are usually in the form of stable dispersions and they cause sizing by depositing rosin-based or other materials on to the fibre stock or the paper web, so that sizing essentially involves breaking the stable dispersion. This can occur on contact between the emulsion and the stock or web, where the latter is effective to destroy the stability of the dispersion. Usually, however, adequate sizing does not arise from mere contact of the paper sizing agent with the paper stock or web and requires the presence of an added reactant to break the dispersion and so cause the desired deposition of sizing components on the fibres of the paper stock or web. By far the commonest agent used is aluminum sulphate, i.e. papermaker's alum, which is particularly efficient, both because of its acid character and because of the effectiveness of the aluminum ion as flocculant. In fact, the majority of sizing agents in use will remain stable in the presence of cellulosic fibres, but will be destabilized in the presence of alum, because the latter is much more reactive than cellulose.

As a consequence of this, a considerable degree of skill has to be exercised in the manufacture of paper, so as to ensure that the stock, the sizing agent and the alum are brought together in the requisite proportions and under such conditions as to effect optimum sizing. In particular, difficulty can arise in ensuring that the correct amount of alum is added, in accordance with the nature and properties of the particular stock and the particular sizing agent in use. Instead of having to add at least two materials to the paper-making stock, namely the sizing agent and alum, it would obviously be of considerable benefit if the sizing agent and the alum or, in general, all the materials which need to be added to the stock, could be combined into a single composition. Not only could this be formulated so as to contain the most appropriate amount of alum for the sizing components present, but also the most effective and therefore economical use of all the materials would follow. It has long been thought that this highly desirable goal could not be achieved, except perhaps only in certain somewhat exceptional cases, because of the fundamental incompatibility of sizing agents and alum. Since the basic purpose of the latter is to destroy the stability of the former, it is not to be expected that a single composition could combine the two and remain in a stable and usable condition.

SUMMARY OF THE INVENTION

The present invention is based upon the surprising discovery that many chemical compositions based upon rosin and reaction products of rosin with other substances, such chemical compositions typically being in the form of stable aqueous emulsions, for use for instance as paper sizing agents, undergo a further and hitherto unsuspected stage of reaction with alum, after the initial breaking of the dispersion, and that persistent agitation of the resultant mixture leads to its re-stabilization in the form of a novel composition which contains both the rosin or rosin reaction products of the original chemical composition and the alum in a mutually-compatible form. Moreover, it has also been discovered that the resultant composition is not only stable, but it is de-stabilized when brought into contact with cellulosic fibres and other fibres used in making paper. Another significant feature is that the chemical compositions of the present invention which are usable as "one-shot" paper sizing agents because of the unexpected properties just described, can include proteinaceous and other stabilizers and yet even these forms of the chemical compositions of the invention also are capable of being de-stabilized by contact with cellulosic fibre and so are usable as highly effective "one-shot" paper sizing agents, i.e. sizing agents which operate on addition to stock or a web without the aid of any other material.

DETAILED DESCRIPTION OF THE INVENTION

According to one aspect of the present invention, a chemical composition suitable for use as a paper sizing agent contains a rosin component and an alum component and, optionally, an amount of stabilizing component sufficient to maintain the composition in a stable form. Preferably, the rosin component is derived from a fortified rosin dispersion.

In its broadest concept, the compositions of the invention comprise stable and homogeneous formulations derived by a process which comprises admixing and agitating the alum component with the rosin component, the latter typically being a dispersion in an aqueous medium and the former being added in the form of a concentrated aqueous solution or, even in solid powder form, and continuing agitation of the resultant mixture for a time sufficient to restore it to a substantially homogeneous and stable form.

According to a preferred aspect of the process of the invention, preparation of a chemical composition is carried out by combining together a rosin component, an alum component and a stabilizing component by adding one of such components to a mixture of the other two under continuous agitation and then, whilst continuing the agitation, adjusting the pH of the resulting three-component mixture by adding an alkali thereto. Preferably, the alum component is added to a mixture of the rosin component and the stabilizing component.

The fortified rosin dispersion preferably utilized as the rosin component is advantageously a rosin-based composition selected from the products which we market under our Regd. Trademarks "BEWOID", "BUMAL" and "ROSCOL". Products which have proved highly satisfactory as the initial rosin components in carrying out this invention include those which have the following characteristics:

(1) "BEWOID" R40X; this product is a free-flowing white fortified rosin dispersion, stabilized with casein and containing 40% solids by wt. "BEWOID" R40X a particle size range of 0.25–1 μmax., a Brookfield viscosity of 15±5 cps @ 20° C., an acid value of 61±2 mg KOH/g and a foam index of 25±10%. Its stability is demonstrated by the fact that it does not crystallise for at least 100 hrs. on heating at 55° C. in a sealed tube.

(2) "BEWOID" R50X is a product of the same general description as "BEWOID" R40X, but contains 50% solids by wt. "BEWOID" R50X dispersion has the same particle size range, foam index and stability as R40X, but in contrast to the latter, it has a Brookfield viscosity of 40±10 cps @ 20° C. and an acid value of 77±2 mg KOH/g. Both "BEWOID" R40X and R50X are made by reacting tall oil rosin with paraformaldehyde using paratoluenesulphonic acid as a catalyst followed by reaction with maleic anhydride. A dispersion is then prepared from the rosin with the aid of caustic potash solution and casein solution.

(3) "BUMAL" is a product in the form of a white rosin dispersion fortified to a greater extent than "BEWOID" dispersion, stabilized with casein and containing 45%±1% solids by wt. "BUMAL" rosin dispersion has the same particle size range, foam index and stability as "BEWOID" R40X and R50X; its acid value is 69±2 mg KOH/g, and Brookfield viscosity is 100±10 cps.

(4) "ROSCOL" is a casein-stabilized rosin dispersion, which differs mainly from the "BEWOID" and "BUMAL" products above in having a lower solids content (30%±1% by wt.) and in being a reaction product of rosin with fumaric acid.

The alum component of the chemical components of this invention is, in effect, aluminum sulphate in an appropriate form for ready handling in the preparation of the compositions. Usually, an aqueous solution of alum is employed, most conveniently, in the form of a 20% wt/vol. solution, though as indicated above powdered alum can be successfully added to the rosin component and the resultant mixture treated by agitation so as to produce a new and stable composition.

The alkali preferably used in making compositions by the process of the invention can be any basic material has no adverse effect upon other components utilized in the preparation, as any skilled person will appreciate, and which is in an appropriate form for ready handling.

The stabilizing component which can optionally be incorporated into the chemical compositions of the invention is conveniently any of a number of proprietary compositions. As indicated in detail in the Examples and other parts of the specification below, selection of the most suitable stabilizing component, where used, the other in which it is combined with the other components and other factors, such as acidity or alkalinity, can be of considerable importance in achieving an efficient and storage-stable product. Preferred materials for use as the stabilizing component include (1) quaternised and other cationic starches, such as the commercially-available products marketed under the designations "AMISOL-Q-TAC" and "AMISOL", (2) nonionic starches, such as the product marketed as "GLOBE" starch, and (3) other stabilizers, including starch-based products, such as cornstarch acetate, and components of the kind exemplified by poly-vinyl pyrrolidone.

In order that the invention may be readily understood, the following description is given, which incorporates examples of the preparation and testing of sizing agents comprising chemical compositions according to this invention, in the manufacture of paper, and, for comparison purposes, examples of the preparation and testing of other paper sizing agents. Though the sizing of paper is a primary application of the components of the invention and the discoveries on which the invention is based have arisen from attempts to provide improved paper sizing systems, it will be appreciated that the chemical compositions of the invention are capable of use in other fields and that the invention is not restricted to the preparation and use of paper sizing agents only.

The invention is based essentially upon discoveries made in connection with the development of paper sizing compositions which incorporate both a size as such and and the alum normally used to precipitate the size in paper manufacture. Although rosin emulsions containing stabilizers and alkali normally are broken on contact with alum, investigations were made to establish whether there were conditions under which alum could be incorporated into rosin emulsions without this occurring, so as to produce a new composition which, like the initial size, also was a stable rosin dispersion and which could nevertheless be broken on contact with fibre, so as to act as a paper sizing composition. During these investigations, not only have these conditions been established, but also it has been discovered that stable rosin dispersions can be derived by adding alum to initial stable rosin dispersions in the absence of proteinaceous or other stabilizers and also in the absence of added alkali.

EXAMPLE 1

Paper Sizing Agents Containing Cationic Stabilizers

This Example illustrates the production from a first stable rosin dispersion of a second stable rosin dispersion which also contains alum, a cationic starch stabilizer and added alkali and which is effective as a one-shot sizing agent when contacted with paper fibre stock.

Preparation 45 g of "BUMAL" fortified rosin dispersion size was agitated at 300 rpm and, while this agitation was maintained, firstly 200 ml of 20% wt/vol aqueous aluminium sulphate solution was added during 10 seconds and then 200 g of a 10% wt/wt solution of a quaternised low-viscosity starch was added. The rate of agitation was then reduced to 75 rpm and 100 ml of 10% wt/vol aqueous sodium hydroxide solution was added, the stirring at 75 rpm then being continued for 30 minutes.

Two paper sizing agents were prepared by this technique, one using as the quaternised low-viscosity starch the product known as AMISOL-Q-TAC-Quaternary No. 3 and the other the cationic starch product known as AMISOL (low viscosity) Quaternary No. 2. Both of these cationic starch products are marketed by Corn Products Ltd.

The preparation of these sizing agents illustrates the technique in which, firstly, the alum component is incorporated into the rosin size component and, secondly, a stabilizing agent is incorporated into the resultant two-component mixture, before the alkali is added to the three-component mixture in the final step. When the first step is carried out, the alum destabilizes the "BUMAL" dispersion, but the continuance of agitation throughout the second and final steps, when the selected cationic starch stabilizer and the alkali are added, eventually gives a smooth homogeneous product of the form of a stable emulsion.

Evaluation

Since a stable rosin dispersion resulted in each case, it was used as a sizing agent in the manufacture of paper hand sheets. 0.34% of rosin based on dry fibre was used. The Cobb values (TAPPI standard 441) obtained with these paper hand sheets were the following:

| Age of Size Product | Stabilizer in Sizing Product | |
|---|---|---|
| | Amisol-Q-Tac | Amisol |
| | Cobb | Cobb |
| 24 hr. | 19 | 17 |
| 2 months | — | 17 |
| 3 months | 16 | — |

EXAMPLE 2

Paper Sizing Agent Using Nonionic Stabilizer

Preparation

The method and ingredients of Example 1 were again employed, except for use of a nonionic starch (Globe) in place of either of the cationic starches. Again, the continued agitation produced a stable product in the form of a dispersion, after initial de-stabilization of the "BUMAL" dispersion by the alum component.

Evaluation

When used as a paper sizing agent in the manufacture of paper hand sheets as described in Example 1, the rosin dispersion with nonionic starch stabilizer gave Cobb values of 50 after 24 hr, and 56 after 3 months.

EXAMPLE 3

Paper Sizing Agents Without Added Stabilizers

This Example shows that a quaternary starch or other stabilizer, normally present in the initial rosin emulsion, is not of critical importance in the preparation of the products of the invention, as satisfactory paper sizing agents can be made which are identical with those of Example 1, except that the starch is not used.

Preparation

The following components were combined in the order given:

| | Amount | Dry Weight |
|---|---|---|
| Fortified rosin size (BUMAL) | 45g | 20.25g |
| Alum - 20% wt/vol | 200ml | 40g |
| NaOH (Molar) | 100ml | to 4g |

The addition of NaOH gave a final pH of 5.0.

Evaluation

The following Cobb values were obtained when testing paper hand sheets sized with various quantities of the resultant product, newly made and after 40 hours.

| Dry weight of rosin to fibre % | Cobb value | |
|---|---|---|
| | After 0 hrs | After 40 hrs |
| 0.32 | — | 121 |
| 0.42 | 34 | — |
| 0.64 | 29 | 52 |
| 0.96 | 26 | 35 |
| 1.6 | — | 32 |

EXAMPLE 4

Paper Sizing Agents Without Added Stabilizers And Without Reduced Alkali

This Example shows that the sizing efficiency of the products of the invention is related to final pH. It has been found that a product which has a pH above 4.7, for example, the paper sizing agent of Example 3 with a final pH of 5, can be modified so as to give a dramatic increase in efficiency, by lowering the pH below 4.7.

Preparation

Example 3 was therefore repeated, using less alkali to produce a final product pH of 3.9.

Evaluation

By making hand sheets from this sizing agent and using a stock pH of 6.55, the following Cobb values were obtained:

| Age of Sizing Product | Cobb Value (Dry wt of rosin to fibre = 0.42%) |
|---|---|
| 0 hr | 17 |
| 24 hr | 19 |
| 48 hr | 19 |
| 72 hr | 24 |
| 100 hr | 24 |
| 1 month | 20 |

It will be seen that the lower pH of the sizing agent makes a considerable difference, which is also applicable to the cationic starch stabilized paper sizing agents of the invention.

EXAMPLE 5

Sizing Agents Containing Cationic Stabilizers—Order of Mixing of Components

This Example illustrates that the order in which the components of a sizing agent according to the invention are admixed can be of importance. A series of preparations were carried out, based essentially upon use of the same components as described in Example 1. In the latter, the alum component was incorporated into the rosin dispersion and the stabilizing agent (e.g. a cationic starch) was then added, incorporation of alkali being the final step.

Preparation

The following materials were used:

| | |
|---|---|
| 45 g | BUMAL rosin dispersion |
| 200 ml | 20% w/v aqueous alum solution |
| 200 g | 10% w/w/ starch (e.g. Amisol-Q-Tac) |
| 40 ml | 10% w/v sodium hydroxide |

In all cases, the alkali was added last as in Example 1; this therefore gives twelve possible combinations for the other components. These consist of two sets of possibilities: Series I—mixing any two components together and then adding the third; Series II—mixing any two components together and adding this mixture to the third component. The mixing was carried out with a glass rod or a slow speed stirrer. The appearance of the mixtures and pH values were noted at various points during the mixing. The results are set out below:

Series I
Third Component added to mixture of First and Second Components

| | Components mixed in beaker | Component added subsequently | Notes |
|---|---|---|---|
| (i) | Alum added to BUMAL | Starch | This is the preparation used in Ex. 1. BUMAL flocculated when the alum was added, but redispersed; starch mixed in easily, as did alkali. |
| | pH 3.4 | pH 3.3 | Final pH 3.9 |
| (ii) | Starch added to BUMAL | Alum | BUMAL mixed easily with starch. Minor flocculation when alum added. Alkali mixed in easily, final mixture more viscous than (i), but also satisfactory |
| | pH 6.7 | pH 3.1 | Final pH 3.7 |
| (iii) | BUMAL added to alum | Starch | Flocs formed as soon as BUMAL contacted the alum which were coarser than in (i) above. |
| | pH 3.3 | pH 3.2 | Final pH 3.4 |
| (iv) | Starch added to alum | BUMAL | Alum and Starch formed a fluid liquid. Coarse ppt. formed on adding BUMAL. Coarser still with alkali addition. |
| | pH 3.0 | pH 3.2 | Final pH 3.5 |
| (v) | Alum added to starch | BUMAL | Identical with (iv) |
| | pH 3.0 | pH 3.2 | Final pH 3.5 |
| (vi) | BUMAL added to starch | Alum | Identical with (ii) |
| | pH 6.7 | pH 3.1 | Final pH 3.7 |

-continued

Series II
Mixture of First and Second Components added to Third Component

| | PREMIXED COMPONENTS | COMPONENT IN BEAKER | NOTES |
|---|---|---|---|
| (vii) | Alum mixed into BUMAL | Starch | Product similar to (i) |
| | | pH 3.3 | Final pH 3.7 |
| (viii) | Starch mixed into BUMAL | Alum | Fine ppt when starch/BUMAL added to alum. Thickened when alkali added, but product still satisfactory. Final pH 3.7 |
| (ix) | BUMAL mixed into alum | Starch | Product similar to (iii) |
| | | pH 3.1 | Final pH 3.3 |
| (x) | Starch mixed into alum | BUMAL | Identical with (xi) |
| | | pH 3.1 | Final pH 3.5 |
| (xi) | Alum mixed into starch | BUMAL | Fine ppt. formed when pre-mix added to BUMAL |
| | | pH 3.1 | Final pH 3.5 |
| (xii) | BUMAL mixed into starch | Alum | Identical with (viii) |
| | | pH 3.1 | Final pH 3.7 |

In the above tables, the stated pH values (correct to ±0.1) apply as follows:

Series I—each pH applies to the respective two-part, three-part or four-part mixture;

Series II—each pH applies to the respective three-part or four-part mixture so obtained.

The most suitable products were Series I (ii) and (vi) and Series II (viii) and (xii), the preferred order of mixing of the components therefore being to mix the starch component with the rosin size component and to combine the mixture with the alum, either by adding the former to the latter or vice versa, before adding the alkali to the resultant three-part mixture. This shows that the best order of mixing of the components, in order to obtain a stable emulsion usable as a one-shot size which operates on contact with fibre, is to combine the starch with the initial rosin dispersion.

EXAMPLE 6

Sizing Agents Containing Other Stabilizers

This Example shows that paper sizing agents according to the invention can be prepared by adding a selected stabilizer to the rosin size dispersion, then adding this to alum or alum to it and finally adding alkali to give the desired product, i.e. using the orders of mixing exemplified by (ii), (vi), (viii) and (vii), in Example 5, but employing different stabilizers. The following results were obtained; each of the non-starch products of Group A was prepared, stored and used at room temperature.

A - Non-starch Stabilizers (i) Hydroxyethyl cellulose stabilizer (cellulose ether) "Cellacol" HE 450DS: 2.5% w/v

| | | | |
|---|---|---|---|
| Make: | BUMAL | 45 g | |
| + | HE 450DS | 200 g | smooth mixture, |

-continued

A - Non-starch Stabilizers (i) Hydroxyethyl cellulose stabilizer (cellulose ether)
"Cellacol" HE 450DS: 2.5% w/v

| | | | |
|---|---|---|---|
| | | | pH 6.5: |
| + | alum | 200 ml | smooth mixture pH 3.7; |
| + | alkali | 40 ml | some transient coagulation which quickly gave a smooth mixture; final pH 4.2. |

This mixture remained quite stable with no sign of separation after 12 days.

(ii) Methyl cellulose stabilizer (cellulose ether)
"Cellacol" M 5000 DS; 1.5% w/v

| | | | |
|---|---|---|---|
| Make: | BUMAL | 45 g | |
| + | M 5000 Ds | 200 g | smooth mixture, pH 6.5; |
| + | alum | 200 ml | immediate decrease in viscosity; no immediate sign of coagulation; pH 3.5; |
| + | alkali | 40 ml | slight transient coagulation which quickly gave a smooth mixture; final pH 4.0. |

Some sedimentation after 3 hours; complete separation after two days. In another test under identical conditions precisely the same unsatisfactory result was obtained with another cellulose ether, namely the hydroxypropylmethyl cellulose stabilizer known as "Cellacol" HPM 5000 DS at 1.5% w/v.

(iii) Polyvinyl pyrrolidone stabilizer-P.V.P. ex BDH:
(M.W. 700,000); 10% w/v

| | | | |
|---|---|---|---|
| Make: | Bumal | 45 g | |
| + | P.V.P. | 200 g. | smooth mixture; pH 3.5; no apparent coagulation; |
| + | alkali | 40 ml | considerable coagulation; final pH 4.0; |

no sedimentation at 24 hours;
stable after 12 days.

(iv) Polyvinyl alcohol stabilizer - PVA ex BDH
(M.W. 125,000); 7% w/v

| | | | |
|---|---|---|---|
| Make: | BUMAL | 45 g | |
| + | P.V.A. | 200 g | smooth mixture; pH 6.4; |
| + | alum | 200 ml | some coagulation similar to No. (ii); pH 3.5; |
| + | alkali | 40 ml | coagulation remained; final pH 4.0. |

Gross sedimentation at 3 hours:
total precipitation after 2 days.

The results summarised above for non-starch stabilizers show that many closely-related compounds often behave in notably different ways when tried as stabilizers for rosin component/alum component compositions of this invention. Example 6(i) shows that hydroxyethyl cellulose is a suitable stabilizer, but Example 6(ii) shows that methyl cellulose and hydroxypropylmethyl cellulose are not. Example 6(iii) and Example 6(iv) show that polyvinyl pyrrolidone is suitable, but polyvinyl alcohol is not. Other compounds which have been tested and found unsatisfactory, either because on addition to BUMAL a smooth composition is not given or because the smooth composition first produced becomes unusable on addition of the alum or the alkali include the following.

| | Compound | Sample | Result |
|---|---|---|---|
| (v) | Sodium alginate | "Manutex" KPF ex Alginate Industries; 1% w/v. | Severe precipitation on adding alum to smooth mixture of BUMAL and sodium alginate |
| (vi) | Polyethyleneimine | "Flocbel" FC21 (MW: 300,000) 23.5% w/v. | Mixture coagulated immediately on adding "Flocbel" FC21 to BUMAL. |
| (vii) | Sodium carboxymethyl cellulose | "Cellufix 1000" ex T.R. International; 1% w/v | Gross coagulation on adding "Cellufix 1000" to BUMAL. |
| (viii) | Polyacrylic acid | P.A.A. ex BDH (MW: 230,000); 12.5% w/v | Immediate gross coagulation on adding alum to BUMAL/P.A.A. mixture |
| (ix) | Methacrylic acid (M.A.A.) | — | This was not tested, in view of the result obtained in Ex. 6 (viii) and the fact that M.A.A. is a fluid liquid. |

B- Starch Stabilizers

In each test the selected starch was prepared @ 95° C. for 20 minutes and then stored @ 50° C. until required. Each starch was used as described in detail for maize starch in Example 6(x).

(x) Maize starch stabilizer; 10% w/v.

| | | | |
|---|---|---|---|
| Make: | BUMAL | 45 g | |
| + | maize starch | 200 g | pH 6.4; a smooth paste resulted; |
| + | alum | 200 ml | pH 3.0; transient coagulation occurred, but mixture became smooth. |
| + | alkali | 40 ml | pH 3.5; considerable coagulation and increase in viscosity mixture very thick at 24 hours; separated after 12 days |

(xi) Rice starch

The mixing states produced mixtures having pH 6.2, pH 2.9 and pH 3.5, with the same results as in Ex. 6(x); the product separated after 12 days.

(xii) Oxidised corn starch (Viscosol 240); 10% w/v

The starch mixed easily with the BUMAL (pH 6.2); there was no apparent coagulation on addition of the alum; pH 3.0; slight coagulation occurred on addition of the alkali; the mixture was quite stable at 24 hours but separated after 12 days.

(xiii) Farina (potato) starch: 10% w/v

The starch mixed easily with the BUMAL (pH 6.4), but considerable coagulation occurred on adding alum; the mixture would not become smooth.

(xiv) Oxidised farina starch: 10% w/v

The starch again mixed easily with BUMAL and the alum mixed easily in the resultant mixture; no apparent coagulation occurred on adding alkali; the respective pH values were 6.2, 3.2 and 3.7; the mixture was quite stable at 24 hours, but separated by 12 days.

(xv) Corn starch acetate: 10% w/v

Each component mixed in easily; pH values of 5.9, 3.1 and 3.6 were noted; the product was quite stable and smooth at 24 hours and still stable after 12 days.

From the above results, it can be readily seen that suitable products can be made using as stabilizing agent "Cellacol" HE 450DS or other forms of hydroxyethyl cellulose, polyvinyl pyrrolidone and corn starch acetate, but similar results are not obtainable with the other materials, even though these are often closely similar to those which succeed and their known properties and uses indicate that they are likely to give good results.

EXAMPLE 7

Paper Sizing Agents With and Without Fortification of Initial Rosin Dispersion This Example illustrates that the addition of large amounts of alum, even in solid form, can be made to many different kinds of rosin dispersions irrespective of whether or not they are fortified with maleated or other rosin reaction products.

Preparation

Using the technique described in Example 1, various rosin emulsions were admixed with powdered alum and NaOH in the solution dry weight ratio of 1:2:0.2, which is equivalent to a total weight ratio of 45:40:4 for BUMAL:alum:50% w/w/NaOH. Many mixtures have been made and have all shown good stability. Different stirring techniques have been used, including high shear (Bewoid), low shear and ultra-high shear (Braun), followed by passing the stirred mixture at low pressure (e.g. 400 psi) through an Ormerod homogeniser. This mixture has approximately a total solids content of 52% dry dish. The homogenisation step is required to enable the product to pass undiluted through a 40-mesh sieve, even under moderate applied pressure. When the unhomogenised product is diluted with water, e.g. 50:50, the product passes through a sieve, but considerable coarse debris is retained. Passage through an Ormerod homogeniser enables the sizing agent to pass through a 40-mesh sieve so as to leave little or no debris, whether or not it is diluted or concentrated. This technique has been used to make stable paper sizing agents from initial fortified and unfortified rosin dispersions, solid powdered alum and caustic soda using the following dispersions:

(i) unfortified protein stabilized dispersion size.

(ii) fortified rosin dispersion size, casein-stabilized, e.g. BUMAL and ROSCOL.

(iii) fortified rosin dispersion size, with no proteinaceous stabilizer.

All these preparations led to the production of storage-stable products capable of retaining sizing efficiency for extended periods (e.g. at least 12 weeks), which were in the form of thixotropic pastes, which very readily liquified on agitation and so were pumpable, but which reset to a thixotropic paste on standing for e.g. 24–48 hours.

These tests show that fortification of the initial rosin dispersion is not a prerequisite of the invention, as both fortified and unfortified rosin sizes can be combined with large amounts of alum without stabilizers to give commercially acceptable products.

EXAMPLE 8

Paper Sizing Agents Without Additional Stabilizer

This Example relates to the unexpected discovery that efficient paper sizing, as shown by acceptable Cobb values, is possible with rosin/alum compositions containing no added stabilizer.

Standard BEWOID R50X size was used in a series of papermaking tests in comparison with a sample of a composition according to the invention made up from 45 g BUMAL, 200 ml 20% w/v alum solution and 40 ml 10% NaOH solution. The Cobb values obtained at various sizing levels and stock pH values were as follows:

| | | Rosin/Fibre | | |
|---|---|---|---|---|
| Stock pH | Size | 1% | 0.5% | 0.25% |
| 7.5 | R50 | 23.5 | 36.5 | — |
| | Sample | 55.7 | 122.0 | Satd. |
| 6.5 | R.50 | 18.7 | 22.6 | 47.3 |
| | Sample | 32.5 | 100.0 | Satd. |
| 4.0 | R.50 Fresh | 20 | 30 | 50 |
| | Sample | 19.3 | 31.5 | 97.2 |
| | Sample after 11 days | 18 | 30 | — |

It will be seen that acceptable results are obtained at pH 4.0 even 11 days after the preparation of the sizing agent (at 1% rosin/fibre) and a performance comparable with R50 even at 0.5% rosin/fibre. Against all expection, an "unstabilized" rosin/alum composition remains stable and is effective merely on contact with paper stock.

EXAMPLE 9

Cationic Paper Sizing Agents—Effect of Alkali

This Example illustrates that in general the formation of stable rosin/alum compositions which have sizing properties is independent of the amount of alkali present.

Part A

Two samples of cationic emulsions were prepared, one caustic free, and the other containing 8% of a 10% NaOH solution. Handsheets were prepared with rosin additions of 0.42% by dry weight of fibre. The results were as follows:

| | | One minute Cobb values | |
|---|---|---|---|
| | pH | After 24 hrs. | After 3 months |
| Caustic free | 3.45 | 26 | 26 |
| Sample containing NaOH | 4.10 | 19 | 16 |

The Cobb obtained at pH 3.45 are satisfactory, showing that the addition of sodium hydroxide is not essential to the longevity of the product. This result verifies that sizing efficiency is dependent on the pH of the cationic dispersion itself, the caustic added to the preparation merely serving to increase the pH to improve the efficiency. Sizing is obtained from products ranging from pH 3.2 to pH 4.7, the optimum being pH 3.7 to to pH 4.3.

Part B

Mixtures were made up using 45 g of BUMAL fortified rosin size and various amounts of solid alum and 50% w/w NaOH solution. Three mixtures incorporated 40 g solid alum with (a) 3 g, (b) 2 g and (c) 1 g NaOH solution respectively, while another three used (d) 30 g alum, (e) 20 g alum and (f) 10 g alum respectively with one-tenth that amount of NaOH solution. All 6 mixtures showed satisfactory stability. The sizing performance was satisfactory for all sample.

EXAMPLE 10

Paper Sizing Agents Containing Wax

Satisfactory sizing performance and long-term stability are shown by rosin dispersion/alum mixtures in the 1:2:0.2 ratio using rosin dispersions containing wax in proportions from 20% to 80% of the rosin content. This shows that compositions according to the invention can include a proportion of wax, if so desired.

EXAMPLE 11

Cationic Sizing Agents—Paper Machine Tests

Cationic sizing agents according to the invention were prepared and were used in the manufacture of paper on a pilot machine, without the independent addition of aluminium sulphate being required. Efficient sizing can be obtained over a pH range of 4.5 to 8.5.

The paper machine used in this Example is a miniature standard Fourdrinier paper machine with a conventional drier train split by an inclined size press.

A cationic sizing agent according to the invention was made up as described in Example I, the stabilizing agent used being AMISOL-Q-TAC. The furnish to the machine was bleached sulphate pulp @ 40° Schopper-Reigler, the untreated stock had a pH of 4.9 and the make-up water a pH of 7.9. The machine made paper having a basis weight of 70 gsm and the sizing agent was added at the rate of 0.34% rosin on fibre. The machine was operated with the backwater circuit open and closed.

The product proved satisfactory on both the open and closed backwater systems. Cobb figures were obtained in the range from 20–30.

When the pH of the system was raised to 7.4 by the addition of sodium aluminate, good sizing was still evident, the Cobb figures ranging from 25–28.

The use of cationic sizing agents according to the invention imparts hard sizing to paper without the subsequent addition of alum being needed; the products of the invention form the basis of a satisfactory one-shot sizing system.

Sizing is possible in a pH band from 4.5 to 7.4.

The shelf life of the products is extremely good, the sizing agents having at least a 10 week minimum shelf like. At a preferred solids level of 27%, acceptable formulations can be made, both as to stability and process runnability. Good efficient sizing is possible at pH 7.0 and above when sodium aluminate is used at the pH control medium. The use of retention aids in the paper stock increases product efficiency. Chalk loadings of up to 17.5% can also be utilised with good sizing, while the simultaneous use of a retention aid further increases the sizing efficiency at the higher chalk loading levels.

These results were obtained by using the above sizing system at a solids level raised to 27%, when Cobb values of 23.3 were found. The cationic emulsion was then changed to a product based on "Roscol", for instance, the paper sizing agent of the above Example 7 (iii) to evaulate its efficiency against conventional emulsion-based products. After a 30-minute period, the emulsion was again changed to the original BUMAL-based product. Chalk loading was added at levels from 5.0% to 17.5%. However, as there was no conventional retention aid running at the 17.5% level, retention was found to be poor when the chalk content was subsequently determined in the finished sheet.

The above Examples show that the paper sizing agents of the invention operate in a highly satisfactory way and enable papermaking to be based upon a one-shot sizing system.

The present invention thus provides novel chemical compositions in the form of stable alum-containing rosin dispersions, which optionally may contain any one or more of added cationic or nonionic stabilizers, waxes and other added components which can be made from a wide variety of fortified and non-fortified rosin dispersions either protein stabilized or protein free. The compositions of the invention have the property of remaining stable despite their high alum content and of nevertheless being destabilized and thus precipitated on contact with paper stock, so that they can be used as the sole additive necessary for effecting sizing in the manufacture of paper. Moreover, the compositions of the invention are notably compatible with conventional rosin sizing agents, and cause no problems when they are brought into use in paper making systems in which conventional rosin sizing materials in the form of either dispersions of soaps have previously been employed. The compositions of the invention are typically highly stable thixotropic pastes which very readily become fluid and therefore pumpable on agitation.

In summary, the present invention has established that a stable rosin dispersion capable of use as a paper sizing agent can be obtained by combining an existing stable rosin dispersion, e.g. a commercial paper sizing agent, with the alum which is traditionally added as a separate component of the paper-making system. The novel alum-containing free-rosin dispersions of the invention can be made under specified conditions which may be summarised as follows:

- on admixing, high speed agitation is essential, e.g. at 150 to 500 rpm, preferably 250–350 rpm, followed by less intensive agitation at low speed when the final step of pH adjustment by alkali addition is carried out; this can be effected at 50 to 150 rpm, preferably 60 to 100 rpm, e.g. 75 rpm as in Example 1;
- the order of adding of the components is such that the alkali is added last;
- the low speed agitation employed to incorporate the alkali is preferably followed by homogenisation so that the product will substantially all pass a 40-mesh screen;
- the final pH is in the range from 3.0 to 5.0 and is preferably below 4.7 and most preferably is in the lower part of this range, e.g. pH 3.5 to 4.2;
- starch based and other stabilizers are capable of incorporation, but are not essential; if they are included, the order of mixing of the rosin, alum and stabilizing component selected preferably excludes addition of the rosin component to a mixture of the other two, the most preferred order being mixing of the stabilizer and the rosin composition followed by addition of the resultant mixture to the alum or vice versa;

if a starch-based or other stabilizing agent is incorporated in the chemical composition, it is preferred that the amount of stabilizer be no more than an amount equal to the dry content of the rosin dispersion.

the chemical compositions of the invention give effective sizing over a pH range of 4.5 to 7.4.

In a preferred embodiment of the composition of the invention, obtained by admixing the rosin comonent: powdered alum: solid alkali in a dry weight ratio of 1:2:0.2, the total weight ratio of the rosin component:alum component:alkali in the composition is 45:40:4. The method of manufacture of such a composition according to the invention comprises combining an alum component in the form of an aqueous solution of alum or solid powdered alum with a rosin dispersion selected from stable fortified or non-fortified free rosin dispersions under continuous agitation, adjusting the resultant mixture to a pH in the range from 3.0 to 5.0 and continuing the agitation for a time sufficient to break up any flocs formed and then to restabilize the combined components in the form of a stable alum-containing rosin dispersion.

What is claimed is:

1. A stable aqueous chemical composition which is suitable for use as a one-sheet sizing agent for paper, which comprises a rosin dispersion component, aluminum sulphate, and optionally an alkali, the pH of said composition being from about 3.0 to about 5.0.

2. A composition according to claim 1 wherein the pH is below 4.7.

3. A composition according to claim 1 wherein the pH is from about 3.5 to about 4.2.

4. A composition according to claim 1 wherein the alkali is sodium hydroxide.

5. A composition according to claim 1 wherein the rosin component is a non-fortified free-rosin-containing aqueous dispersion.

6. A composition according to claim 1 wherein the rosin component is a fortified free-rosin-containing aqueous dispersion.

7. A composition according to claim 1 which also comprises at least one stabilizing component selected from the group consisting of cationic starches, nonionic starches, hydroxyethyl, cellulose, polyvinyl pyrrolidone, and corn starch acetate.

8. A composition according to claim 1 wherein the dry weight ratio of the rosin component:aluminum suphate:alkali is about 1:2:0.2.

9. A method of manufacturing of an aqueous chemical composition which is suitable for use as a one-shot sizing agent for paper, which comprises the steps of:

a. combining a rosin dispersion component and aluminum sulphate under continuous high speed agitation;

b. optionally, adjusting the pH of the resultant mixture to between about 3.0 to about 5.0 with an alkali, under lower speed agitation;

c. continuing the lower speed agitation for a time sufficient to break up any flocs formed; and d. homogenizing the mixture so that it will substantially all pass a 40-mesh screen;

whereby a stable dispersion is obtained.

10. A method according to claim 9 wherein the pH is adjusted to between about 3.5 and 4.2.

11. A method according to claim 9 wherein the alkali is sodium hydroxide.

12. A method according to claim 9 wherein the aluminum sulphate is added in the form of an aqueous solution.

13. A method according to claim 9 wherein the aluminum sulphate is added in the form of solid powdered aluminum sulphate.

14. A method according to claim 9 wherein the rosin component is a non-fortified free-rosin-containing aqueous dispersion.

15. A method according to claim 9 wherein the rosin component is a fortified free-rosin aqueous dispersion.

16. A method according to claim 9 wherein the dry weight ratio of the rosin component:aluminum sulphate:alkali is about 1:2:0.2.

17. A method according to claim 9 which comprises the additional step of combining the rosin dispersion component with at least one stabilizing component selected from the group consisting of cationic starches, nonionic starches, hydroxyethyl cellulose, polyvinyl pyrrolidone, and corn starch acetate prior to combining the resultant mixture with aluminum sulphate.

18. A method according to claim 17 wherein the mixture of the rosin dispersion component and the stabilizing component is added to the aluminum sulphate.

19. A method according to claim 17 wherein the aluminum sulphate is added to the mixture of the rosin dispersion component and the stabilizing component.

20. A method of sizing paper by a one-shot process which comprises adding the composition of claim 1 to a cellulosic, or other fibre, stock from which a web is subsequently made.

21. A method of sizing paper by a one-shot process which comprises adding the composition of claim 7 to a cellulosic, or other fibre, stock from which a web is subsequently made.

22. A method of sizing paper by a one-shot process which comprises applying the composition of claim 1 to a pre-formed web of cellulosic or other fibres.

23. A method of sizing paper by a one-shot process which comprises applying the composition of claim 7 to a pre-formed web of cellulosic or other fibres.

* * * * *

UNITED STATES PATENT AND TRADEMARK OFFICE

CERTIFICATE OF CORRECTION

PATENT NO. : 4,333,795

DATED : June 8, 1982

INVENTOR(S) : Peter C. Street

It is certified that error appears in the above-identified patent and that said Letters Patent are hereby corrected as shown below:

Col. 4, line 4, after "material" insert --which--
line 14, change "other" to --order--
line 34, change "components" to -- compositions --
Col. 5, line 32, change "of" to -- in --
Col. 6, line 41 of heading change to read -- With Reduced Alkali--
Col. 12, line 50, change "of" second occurrence to -- to --

Col. 14, line 2, change "evaulate" to -- evaluate --
Col. 15, line 12, change "comonent" to -- component --
line 29, change "one-sheet" to -- one-shot --

Signed and Sealed this

Nineteenth Day of April 1983

[SEAL]

Attest:

GERALD J. MOSSINGHOFF

Attesting Officer

Commissioner of Patents and Trademarks